US007892159B2

(12) United States Patent
McVay et al.

(10) Patent No.: US 7,892,159 B2
(45) Date of Patent: Feb. 22, 2011

(54) VARIABLY CONFIGURED EXERCISE DEVICE

(75) Inventors: John McVay, Canton, OH (US); Jane Kmatz, Louisville, OH (US); Robert Schnabel, Jr., Navarre, OH (US); Detlev F. Smith, Fairlawn, OH (US)

(73) Assignee: Engineering Fitness International Corp., San Diego, CA (US)

( * ) Notice: Subject to any disclaimer, the term of this patent is extended or adjusted under 35 U.S.C. 154(b) by 0 days.

(21) Appl. No.: 11/622,298

(22) Filed: Jan. 11, 2007

(65) Prior Publication Data

US 2007/0111866 A1 May 17, 2007

Related U.S. Application Data

(63) Continuation of application No. 10/758,448, filed on Jan. 15, 2004, now abandoned.

(51) Int. Cl.
*A63B 26/00* (2006.01)

(52) U.S. Cl. ..... 482/142; 482/121

(58) Field of Classification Search ..... 482/142, 482/51, 62–63, 72, 92–96, 121–126, 129–131, 482/135, 139, 140, 148
See application file for complete search history.

(56) References Cited

U.S. PATENT DOCUMENTS

| | | | | |
|---|---|---|---|---|
| 4,101,124 | A | 7/1978 | Mahnke | |
| 4,383,684 | A | 5/1983 | Schliep | |
| 4,911,438 | A | 3/1990 | Van Straaten | |
| 4,974,832 | A | 12/1990 | Dalebout | |
| 5,195,935 | A | 3/1993 | Fencel | |
| 5,354,251 | A | 10/1994 | Sleamaker | |
| 5,620,403 | A | 4/1997 | Lundin | |
| 5,785,631 | A | 7/1998 | Heidecke | |
| 5,938,571 | A | 8/1999 | Stevens | |
| 5,967,955 | A * | 10/1999 | Westfall et al. | 482/142 |
| 6,409,631 | B1 | 6/2002 | Alessandri | |
| 6,458,060 | B1 | 10/2002 | Watterson et al. | |
| 6,547,702 | B1 | 4/2003 | Heidecke | |
| 6,582,300 | B2 | 6/2003 | Wantanabe et al. | |
| 6,626,799 | B2 | 9/2003 | Watterson et al. | |
| 6,634,996 | B2 * | 10/2003 | Jacobsen | 482/96 |
| 6,692,412 | B2 | 2/2004 | Chen et al. | |
| 6,786,847 | B1 * | 9/2004 | Morgan et al. | 482/6 |
| 6,981,932 | B1 * | 1/2006 | Huang et al. | 482/72 |
| 2002/0132710 | A1 * | 9/2002 | Jacobsen | 482/123 |
| 2007/0117696 | A1 * | 5/2007 | Gerschefske | 482/142 |

* cited by examiner

*Primary Examiner*—Lori Baker
(74) *Attorney, Agent, or Firm*—Stephen C. Beuerle; Procopio Cory Hargreaves & Savitch LLP

(57) ABSTRACT

A variably configured exercise device may include a vertical support member having a longitudinal axis, a sliding member configured to move along the vertical support member in a direction substantially parallel to the longitudinal axis, a pair of rails each having first and second end portions. The first end portion of each rail can be pivotally connected to the sliding member on the vertical support member. The exercise device can further include an actuation mechanism coupled to the sliding member where the actuation mechanism can be configured to selectively adjust the position of the sliding member relative to the vertical support member.

12 Claims, 6 Drawing Sheets

VARIABLY CONFIGURED EXERCISE DEVICE

This continuation patent application claims priority from a utility patent filed on Jan. 15, 2004, having Ser. No. 10/758,448.

BACKGROUND

The present application relates to a variable configuration exercise device. In particular, the present application relates to a variable configuration exercise device that can be adjusted to change the orientation of a support surface (e.g., height, inclination, etc.) and/or the resistance provided for by the exercise device.

In some exercise devices, the exerciser can sit, lie, or stand on a seat or other support platform (e.g., a bench) and, from this position, the exerciser can perform a series of exercise routine depending on the type of exercise device that the exerciser is using. Currently, support platforms can be adjusted by the exerciser, for example in height, so that the inclination of the support platform can be changed to suit the exerciser. Depending on the exercise device, the adjustment of the inclination can also change the resistance experienced by the exerciser when performing certain exercise routines. Generally, this adjustment is a manual one and must be carried out each time in accordance with a change of exercise or for a different user.

In such exercise devices, orientation adjustment and/or resistance adjustment can be accomplished through manual means through the use of removable locking devices such as locking pins. The locking pins are configured to retain the support platform in a fixed orientation when engaged, yet permit the exerciser to remove the pin and fix the support platform in another orientation. Since adjustment is manual, the exerciser typically has to dismount the exercise device to adjust the orientation and/or resistance.

BRIEF DESCRIPTION OF THE DRAWINGS

It will be appreciated that the illustrated boundaries of elements (e.g., boxes or groups of boxes) in the figures represent one example of the boundaries. One of ordinary skill in the art will appreciate that one element may be designed as multiple elements or that multiple elements may be designed as one element. An element shown as an internal component of another element may be implemented as an external component and vice versa.

Further, in the accompanying drawings and description that follow, like parts are indicated throughout the drawings and description with the same reference numerals, respectively. The figures are not drawn to scale and the proportions of certain parts have been exaggerated for convenience of illustration.

DETAILED DESCRIPTION

The present application is directed to exercise devices that include one or more support surfaces that can be adjusted to control one or more operating parameters of the exercise device, such as resistance, inclination or other similar operating parameters. While the present application will be described in the context of a multi-function exercise device such as the Total Gym.RTM., an incline sit-up board, and a lateral slide exercise device, it should be understood that the present application is not limited to any particular type of exercise device. To the contrary, the actuation mechanism described herein can be readily adapted to any exercise device to adjust the orientation of the one or more support surfaces to control an operating parameter of the device such as resistance. As used herein, the term "exercise device" shall refer broadly to any type of exercise machine, including, but not limited to, incline sit-up devices, lateral sliding exercise devices, weight benches, treadmills, exercise cycles, Nordic-style ski exercise devices, rowers, steppers, elliptical or striding exercise devices.

Figure 1:
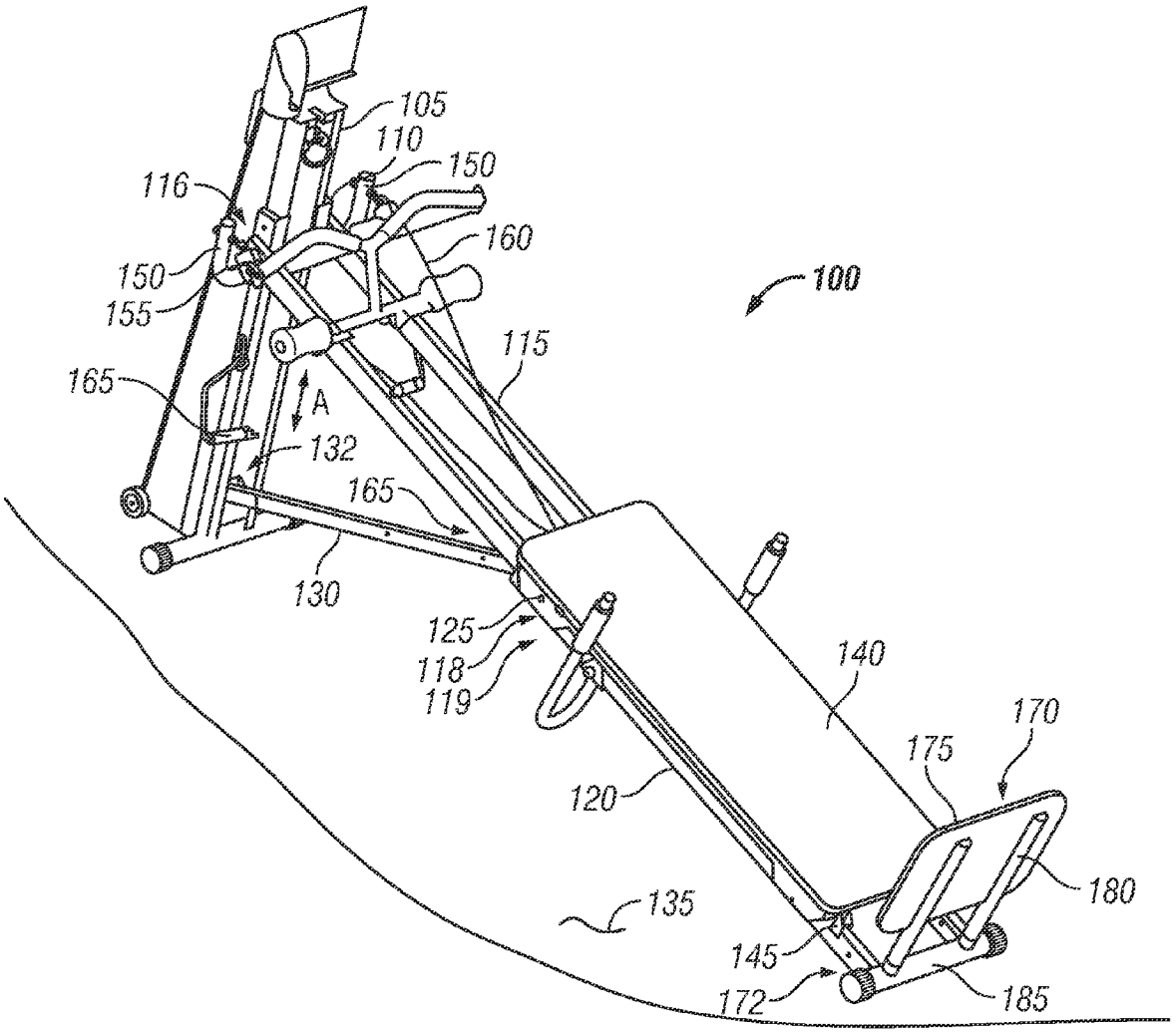
FIG. 1 is a perspective view of one embodiment of a variably configured exercise device 100.
Figure 2:
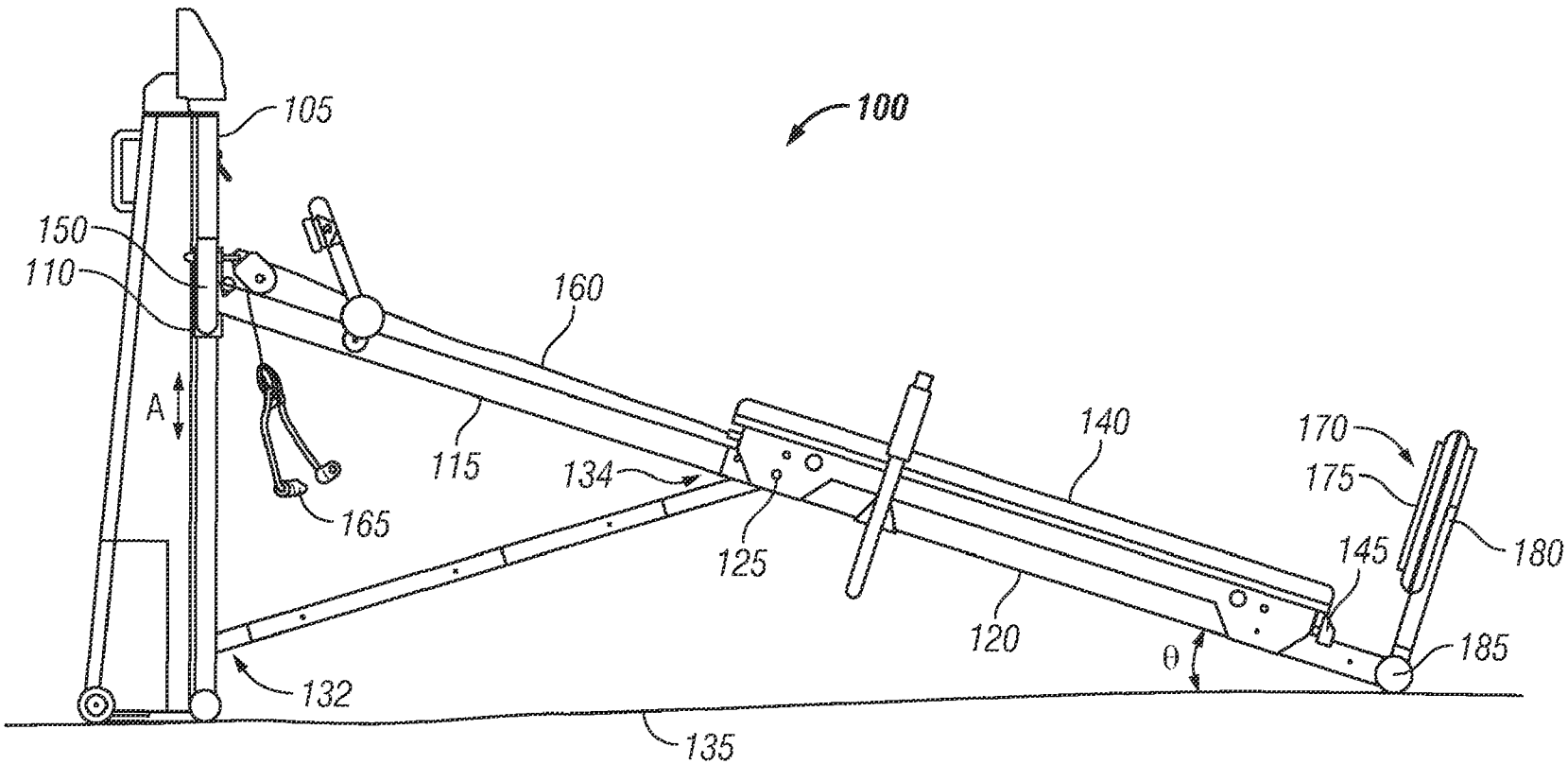
FIG. 2 is a side elevation view of the variably configured exercise device 100.

FIGS. 1 and 2 illustrate a perspective view and a side elevation view of one embodiment of an exercise device 100, respectively. The exercise device 100 can include an upright support post or vertical support member 105 and guide or sliding member 110. The sliding member 110 can be configured to be selectively moved along the vertical support member 105 in a direction, represented by arrows A, substantially parallel to the vertical support member 105. In one embodiment, the sliding member 110 can be configured to receive the vertical support member 105 and permit the sliding member 110 to slide freely upwardly and downwardly along the vertical support member 105. Alternatively, the sliding member 110 can be configured to be received by the vertical support member 105 for relatively smooth sliding motion. Optionally, to reduce friction between the sliding member and the vertical support member 105, bushings (not shown) may be provided.

In one embodiment, the exercise device 100 can be configured to be collapsible such that it can be folded for relatively easy storage as shown and described in U.S. Pat. No. 5,967,955, which is hereby incorporated by reference in its entirety herein. In such an embodiment, the exercise device 100 can include a pair of inner rails 115. Each inner rail 115 has a first end portion 116 pivotally connected to the sliding member 110, and a second end portion 118 pivotally connected to a first end portion 119 of an outer set of rails 120 at a rail pivot point 125. Obviously, the exercise device 100 can be configured such that the inner and outer rails are reversed where the first end portion 119 of each outer rail 120 is pivotally connected to the sliding member 110.

To provide support for the inner and outer sets of rails 115, 120 and to provide collapsible support for the rails 115, 120, a strut 130 can be provided. The strut 130 has a first end portion 132 that can be pivotally connected to a lower portion of the vertical support member 110 and a second end portion 134 that can be pivotally connected to the rail pivot point 125. Optionally, the second end portion 134 of the strut 130 may be pivotally connected to the rail pivot point 125, while the first end portion 132 can rest on a support surface 135 such as a floor or other support platform.

In an alternate embodiment and when collapsibility may not be desired, the exercise device 100 can include a single pair of rails (not shown) as opposed to two pairs of rails (i.e., the inner and outer pairs of rails 115, 120). In this embodiment, the first end of the single pair of rails can be pivotally connected to the sliding member 110. Also, depending on the design, a strut may or may not be provided. It will be appreciated that in either the collapsible or non-collapsible embodiments, a single rail may be used in place of a pair of rails.

With continued reference to FIG. 1, the exercise device 100 can further include a user support platform 140 having rollers (not shown) provided on a bottom side thereof. The rollers on the user support platform 140 can be configured to engage and roll along the inner and outer pair of rails 115, 120. To prevent the user support platform 140 from rolling too far down the outer rails 120, a bumper 145 can be positioned on at least one of the outer rails 120.

In one embodiment, the sliding member 110 can include pulley support bars 150 extending from opposite sides thereof. The pulley support bars 150 can, for example, be L-shaped and extend out from the sliding member 110 in a direction substantially perpendicular to the direction of sliding A of the sliding member 110. To prevent interference between the pivotal movement of the inner rails 115 relative to the sliding member 110, the pulley support bars 150 can extend outward from the sliding member 110 beyond the outer edge of the inner rails 115. Attached to the pulley support bars 150 are pulleys 155.

The exercise device 100 can further include a connector extending through the pulleys 155 and connecting to the user support platform 140. The connector may be of any suitable well-known type, but shown by way of example in FIG. 1 is a cable 160. The cable 160 can include handles 165 at each end. In one embodiment, the cable 160 can extend through the two pulleys 155 positioned on the pulley support bars 150 and loop through a third pulley (not shown) attached to the user support platform 140 along the lateral centerline of the user support platform 140. This position allows for unilateral (i.e. one arm), bilateral (i.e., two arm) and static equilibrium (i.e. holding the user support platform 140 suspended by keeping a constant force on each handle 165) use. The cable 160 should be of sufficient length to extend through the pulleys 155 and allow the exerciser to grasp one or both of the handles 165 while the exerciser is on the user support platform 140 and the user support platform 140 is at rest.

In an alternate embodiment, the connector may be two separate cables extending through the pulleys 155 with each cable fixedly attached to the user support platform 140.

In one embodiment, the exercise device 100 may further include a footrest 170 provided at a second end 172 of the outer set of rails 120. For example, the footrest 170 can include a pressure plate 175 attached to support bars 180 that are coupled to the second end 172 of the outer set of rails 120 by a cross member 185. When that exercise device 100 is in an unfolded state, the footrest 170 can be, for example, positioned substantially perpendicular to the second end 172 of the outer set of rails 120. In one embodiment, the footrest 170 is removable; however it will be appreciated that the footrest 170 can be permanently attached to the outer rails 120.

As stated above, the sliding member 110 can be moved along the vertical support member 105. The sliding member 110 can be at least partially supported by and incrementally moveable along the vertical support member 105 via an actuation mechanism (not shown). In one embodiment, the actuation mechanism can adjust the position of the sliding member 110 along the vertical support member 105 in a linear direction A, which is substantially parallel to the vertical support member 105. The vertical adjustment of the sliding member 110, in turn, can vary the inclination of the user support platform 140 relative to the floor. As used herein, an actuation mechanism refers to a powered mechanism for changing the position of elements of the exercise device to adjust orientation of a support surface of the exercise device and/or the resistance of the exercise device to movement induced by the user.

By varying the position of the sliding member 110 along the vertical support member 105, the angle .theta. between the rails 115, 120 and the floor 135 (illustrated in FIG. 2) may be adjusted. The adjustment of this angle alters the percentage of the exerciser's weight that the exerciser's muscles are moving (i.e., resistance). This allows for adjustment of the intensity of the exerciser's workout. At the lowest level, the exerciser's muscles can be moving 5% of the exerciser's body weight; at the highest level the exerciser's muscles can be moving 60%. Weight bars (not shown) may be added to the user support platform 140 so that weight plates (not shown) may be positioned on the weight bars, thus adding to the weight propelled by the exerciser's muscles.

Figure 3:
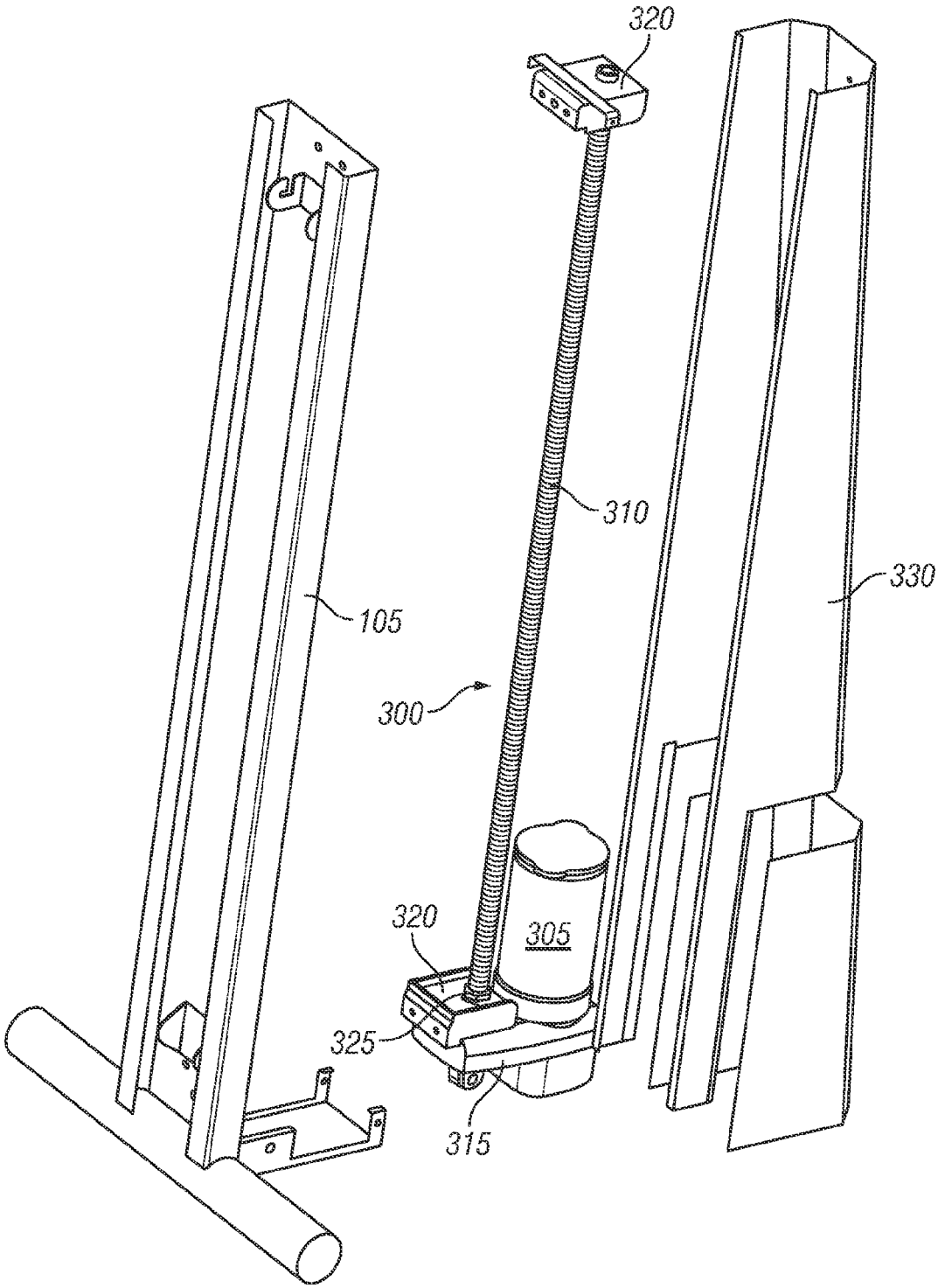
FIG. 3 is a perspective, exploded view of one embodiment of an actuation mechanism 300.

FIG. 3 illustrates an exploded perspective view of one embodiment of an actuation mechanism. One suitable example of an actuation mechanism is a leadscrew assembly 300. The leadscrew assembly 300 can include a drive motor 305 coupled to a leadscrew 310. In one embodiment, the drive motor 305 can be coupled to the leadscrew 310 via a gear box 315. In an alternate embodiment, the leadscrew 310 can be directly coupled to the shaft of the drive motor 305 by any suitable coupling. The drive motor 305 can be, for example, a bi-directional motor configured to be selectively rotated in a clockwise or counterclockwise direction which, as described further below, will cause the sliding member 110 to raise or lower with respect to the vertical support member 105. However, it will be appreciated that other types of motors can be used such as AC motors, DC motors, and stepper motors.

It will be appreciated that other suitable electromechanical actuation mechanisms can be used instead of leadscrew assemblies such as belt driven linear actuators, linear slides, rack and pinion assemblies, and linear servomotors. It will also be appreciated that other types of actuation mechanisms can be used such as slides that are powered hydraulically, pneumatically, or electromagnetically. The foregoing applies to all actuation mechanisms described herein.

In one embodiment, the leadscrew 310 can include an external thread profile. The external thread profile can be, for example, an ACME thread profile. The leadscrew 310 can be any desired length depending on the range of motion required for any exercise device.

The leadscrew assembly 300 can include mounting brackets 320 at each end of the leadscrew 310 for mounting the leadscrew assembly 300 to the vertical support member 105. To support the leadscrew 310 and to ensure smooth rotational motion of the leadscrew 310, thrust bearings 325 can be provided in each mounting bracket 320. To house and protect the leadscrew assembly 300, a shroud 330 is mounted to the vertical support member 105.

Figure 4:
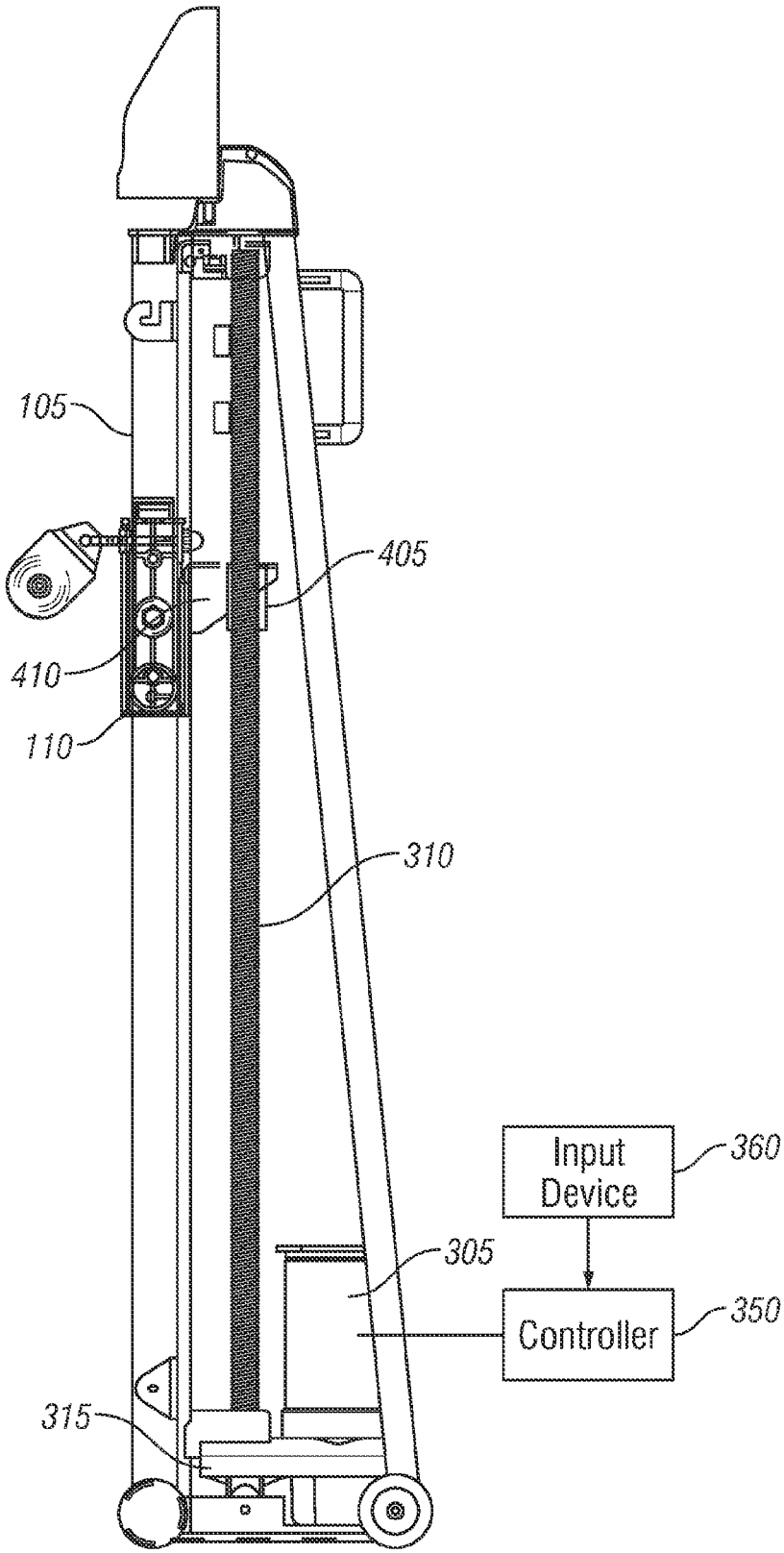
FIG. 4 illustrates a cross-sectional view of one embodiment of the actuation mechanism 300.

FIG. 4 illustrates a cross-sectional side view of one embodiment of the leadscrew assembly 300. To convert the rotary input motion of the motor 305 and leadscrew 310 to linear output motion to selectively raise and lower the sliding member 110 along the vertical support member 105, a driving element or threaded driven member 405 can be threadedly engaged with the leadscrew 310 and attached to the sliding member 110 by a mounting bracket 410. In one embodiment, the driving element 405 can be a leadscrew nut. The driving element 405 can have an internal thread profile that matches the external thread profile of the leadscrew 310 to ensure mating rotational contact between the driving element 405 and the leadscrew 310. In general, as the leadscrew 310 is rotated, the driving element 405 will move in a linear direction A along the leadscrew 310. Since the leadscrew nut 405 is attached to the sliding member 110, the sliding member 110 can be raised or lowered relative to the vertical support member 105.

In an alternate embodiment, the actuation mechanism can directly support and incrementally adjust the position of the first end 116 of the first pair of rails 115 along the vertical support member 105 without the need for a sliding member 110. In yet another alternate embodiment, the actuation mechanism can replace both the vertical support member 105 and the sliding member 110 by exclusively supporting the rails and being configured to raise and lower the first end 120 of the first set of rails 115.

To control the movement of the actuation mechanism 300 and change the vertical position of the sliding member 110, a controller or processor 350 can be provided. The controller 350 can be configured to communicate and control the motor 305 that is coupled to the actuation mechanism 300. For example, the controller 350 can control the speed and rotational direction of the motor 305. It will be appreciated that the controller can be a valve when the actuation mechanism is powered pneumatically or hydraulically.

In one embodiment, the initiation of a change in vertical position of the sliding member 110 can be activated by a control signal generated by an input device 360. Suitable input devices can include transducers, sensors and switches. Sensors and transducers can convert physical data such as speed, position, temperature, acceleration and pressure into electrical signals that are recognized by the controller. Switches can be configured to permit the operator to initiate, halt, or modify action in the controlled system, including turning electric, electromagnetic, pneumatic, and hydraulic devices on and off In one embodiment, input device 360 can be provided on the vertical support column 105 to permit the exerciser to adjust the position of the sliding member 110 relative to the vertical support column 105. In this embodiment, the input device can take the form of a "up" and "down" switch that is electrically connected to the controller and is configured to permit the exerciser to independently control the movements of the sliding member 110.

In another embodiment, input device 360 can be provided on at least one of the handles 165 to permit the exerciser to adjust the position of the sliding member 110 relative to the vertical support column 105 while performing an exercise routine. In this embodiment, the input device can take the form of a switch having a wireless emitter that is configured to transmit a control signal to a wireless receiver in the controller. The input device can be connected to the controller through different kinds of wireless transmission means (e.g., radio frequency (RF), infrared (IR), bluetooth (see www-.bluetooth.org/spec/ for information on the Bluetooth Specification), or any other recognized wireless transmission protocol. Other types of suitable transmission means can include satellite, modem, cable modem, DSL, ADSL connection, ISDN, Ethernet, or other similar connections, voice activated, and the like.

In yet another embodiment, input device 360 can take the form of a remote control configured to permit the exerciser or a trainer to adjust the inclination of the user support platform 140. In this embodiment, the remote control can include a wireless emitter that is configured to transmit a control signal to a wireless receiver in the controller.

In yet another embodiment, an input device may be provided at both ends of the leadscrew 310 to provide the controller with "out of bounds" information. For example, the input device may take the form of an optical switch that is configured to terminate power to the motor 305 upon activation of one of the optical switches. Other suitable input devices that can be used instead of optical switches include mechanical switches that are activated by physical contact, hall effect switches that are activated by magnetic properties, and inductive proximity switches.

In use, the exerciser can position himself or herself on the user support platform 140 in the supine position and grasp one or both of the handles 165. The exerciser can then draw one or both of the handles 165 toward the exerciser and, by doing so, transports the user support platform 140 up along the inner and outer rails 115, 120. An exerciser may also vary the resistance while working upper body muscles by positioning himself or herself on the user support platform 140 with the exerciser's feet on the floor. The legs and lower body then provide assistance in moving the user support platform 140 lessening the load on the upper body muscles.

In an alternate embodiment, the exerciser may position him or herself on the user support platform 140 with the exerciser's feet positioned on the footrest 170. The exerciser may then extend the exerciser's legs to move the user support platform 140 up along the rails 115, 120.

To selectively adjust the inclination of the user support platform 140 and/or vary the resistance before the exerciser positions himself or herself on the user support platform 140, the exerciser can activate the "up/down" switch located on the vertical support member 110 or remote control. By pressing the "up" button on the switch, the inclination of the user support platform 140 can be incrementally increased (i.e., the angle .theta. is increased). On the other hand, by pressing the "down" button on the switch, the inclination of the user support platform 140 can be incrementally decreased (i.e., the angle .theta. is decreased).

To selectively adjust the inclination of the user support platform 140 and/or vary the resistance while the exerciser is positioned on the user support platform 140, the exerciser can activate the "up/down" switch located on one of the handles 165. By pressing the "up" button on the switch, the inclination of the user support platform 140 can be incrementally increased. On the other hand, by pressing the "down" button on the switch, the inclination of the user support platform 140 can be incrementally decreased.

If the exerciser is working with a trainer/instructor, the trainer/instructor can observe the exerciser and control the exerciser's device from a remote location. For example, the trainer/instructor can use the remote control to selectively adjust the inclination of the user support platform 140 and/or vary the resistance while the exerciser is positioned on the user support platform 140. This feature can permit the trainer/instructor to control multiple exercise devices when used in a classroom or group setting.

Figure 5:
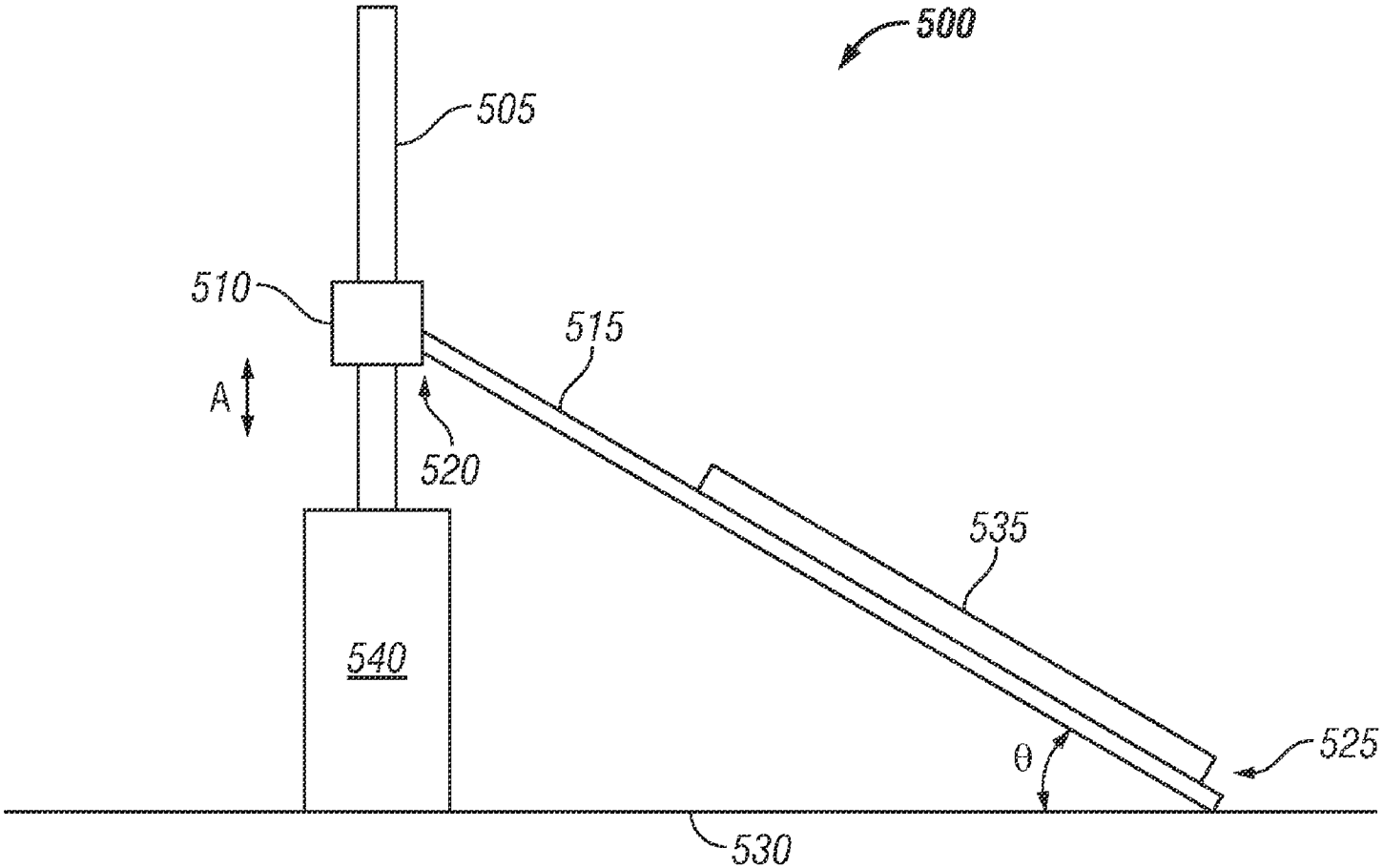
FIG. 5 is a side view of another embodiment of a variably configured exercise device 500.

FIG. 5 illustrates a side view of another embodiment of a variably configured exercise device 500 such as an adjustable inclined sit-up device. The exercise device 500 can include a vertical support member 505 and a sliding member 510. The sliding member 510 can be configured to be selectively moved along the vertical support member 505 in a direction, represented by arrows A, substantially parallel to the vertical support member 505. In one embodiment, the sliding member 510 can be configured to receive the vertical support member 505 and permit the sliding member 510 to slide freely upwardly and downwardly along the vertical support member 505. Alternatively, the sliding member 510 can be configured to be received by the vertical support member 505 for relatively smooth sliding motion. Optionally, to reduce friction between the sliding member 510 and the vertical support member 505, bushings (not shown) may be provided. In one embodiment, the sliding member may further include at least one foot retainer (not shown) to hold the exerciser's feet in place while the exerciser is performing a sit-up or other exercise routine.

In one embodiment, the exercise device 500 can include at least one rail 515 having a first end portion 520 pivotally connected to the sliding member 510, and a second end portion 525 configured to rest on a support surface 530 such as a floor or other support platform. The exercise device 500 can further include a user support platform 535 mounted to the rail 515.

As stated above, the sliding member 510 can be selectively moved along the vertical support member 505. The sliding member 510 can be at least partially supported by and incrementally moveable along the vertical support member 505 via an actuation mechanism 540. The actuation mechanism 540 can include a lead screw assembly such as the actuation mechanism illustrated in FIGS. 3 and 4 and described above or any other actuation mechanism previously described.

In one embodiment, the actuation mechanism 540 can adjust the position of the sliding member 510 along the vertical support member 505 in a linear direction A. The vertical adjustment of the sliding member 510, in turn, can vary the inclination of the user support platform 535 relative to the floor 530. By varying the position of the sliding member 510 along the vertical support member 505, the angle .theta. between the rail 515 and the floor 530 may be adjusted. The adjustment of this angle can alter the amount of resistance experienced by the exerciser when performing an exercise routine such as a sit-up. For example, increasing the angle .theta. can create more resistance, while decreasing the angle .theta. can create less resistance.

To control the movement of the actuation mechanism 540 and change the vertical position of the sliding member 510, a controller and one or more input devices can be provided such as the ones described above. The controller and input device (s) can operate in a substantially similar fashion as described above.

Figure 6:
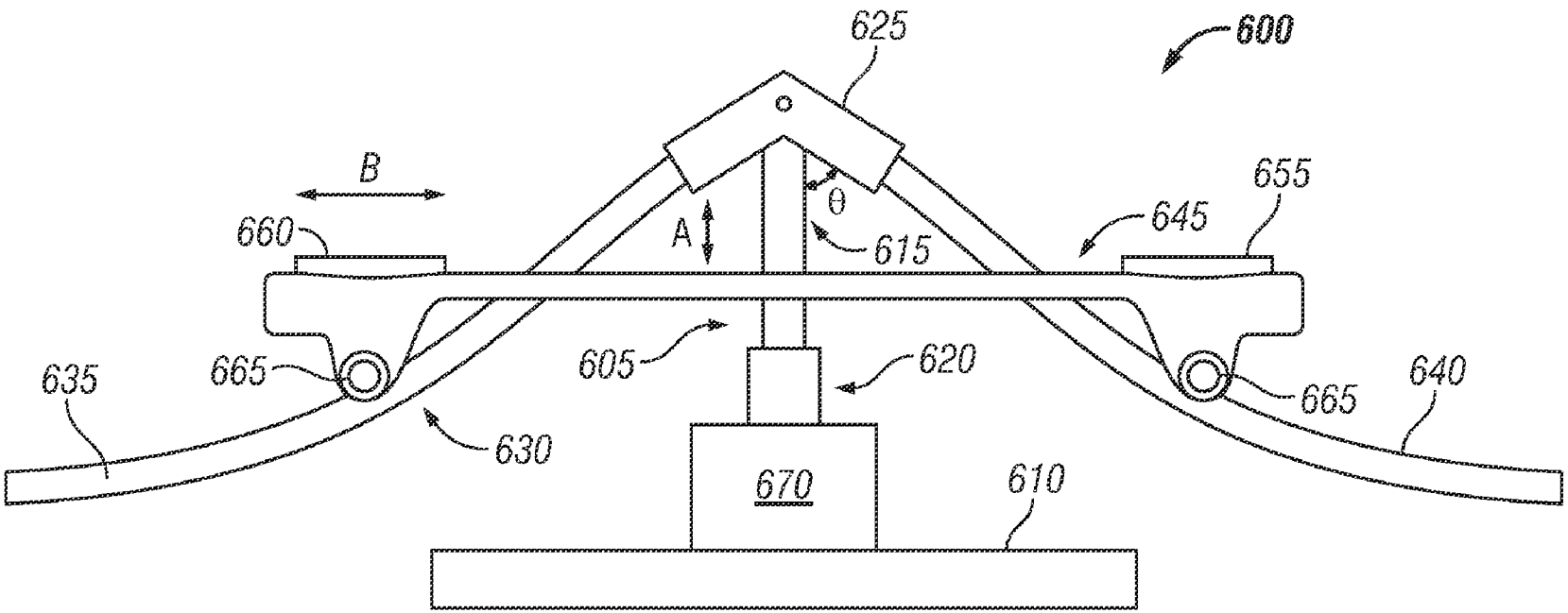
FIG. 6 is a side view of yet another embodiment of a variably configured exercise device 600.

FIG. 6 illustrates a side view of another embodiment of a variably configured exercise device 600 such as a lateral sliding exercise device. The exercise device 600 can include a center support member 605 attached to a base 610. The center support member 605 can be configured to be adjusted in a vertical direction, represented by arrows A, substantially perpendicular to the base 610.

In one embodiment, the center support member 605 may include a foundation portion 615 and a telescopic portion 620 for selective adjustment of the height of the center support member 605. At the top portion of the telescopic portion 620 of the center support member 605, a center rail pivot member 625 can be provided.

Extending from the pivot member 625 and pivotally coupled thereto is a rail assembly 630. The rail assembly 630 can include a first pair of spaced apart rails 635 pivotally coupled to one side of the pivot member 625 and a second pair of spaced apart rails 640 pivotally coupled to the other side of the pivot member 625. Both pairs of rails 635, 640 can slope down and away from the center support member 605 as shown in FIG. 6.

In one embodiment, the exercise device 600 can further include a slide member that rides along the rails 635, 640 in a general lateral motion, represented by arrows B. The slide member 645 can include first and second foot rests 655, 660 disposed on opposite side of the center support member 605. The foot rests 655, 660 can each include rollers 665 that engage the rails 635, 640.

In one embodiment, the telescopic portion 620 of the center support member 605 can be selectively adjusted along the linear direction A via an actuation mechanism 670. The actuation mechanism 670 can include a lead screw assembly such as the actuation mechanism illustrated in FIGS. 3 and 4 and described above or any other actuation mechanism previously described.

In one embodiment, the actuation mechanism 670 can adjust the position of the telescopic portion 620 of the center support member 605 in a linear direction A. The vertical adjustment of the telescopic portion 620 of the center support member 605, in turn, can vary the slope of the rails 635, 640 relative to the floor. By adjusting the slope of the rails 635, 640, the angle .theta. between the rails 635, 640 and the center support member 605 may be adjusted. The adjustment of this angle can alter the amount of resistance experienced by the exerciser when performing a lateral slide exercise routine. For example, increasing the angle .theta. can create more resistance, while decreasing the angle .theta. can create less resistance.

To control the movement of the actuation mechanism 670 and change the vertical position of the telescopic portion 620 of the center support member 605, a controller and one or more input devices can be provided such as the ones described above. The controller and input device(s) can operate in a substantially similar fashion as described above.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A physical exercise/therapy apparatus comprising:

at least one rail having a first end portion that is supported on a floor and a second end portion;

a vertical support member configured to receive, hold, and allow vertical translation of the second end portion of the at least one rail so that the at least one rail is held at a selected inclination angle Θ relative to the floor;

a user support platform slidably engaged with the at least one rail;

an input device, located adjacent to or on the user support platform, and configured to receive and implement a command for a change in at least one parameter of the apparatus which varies as a result of vertical translation of the second end portion of the at least one rail; and an actuation mechanism, associated with the vertical support member, and operatively associated with the second end portion of the at least one rail, the actuation mechanism configured to translate the second end portion along the vertical support member by a selected amount in response to receipt of a control signal from the input device, wherein the actuation mechanism includes a leadscrew assembly having a drive motor and a lead screw, the drive motor coupled to the lead screw for rotating the lead screw to cause translation of the second end portion of the at least one rail along the vertical support member by a selected amount in response to receipt of a control signal from the input device.

2. The apparatus of claim 1, wherein the at least one parameter is the inclination angle Θ of the at least one rail relative to the floor.

3. The apparatus of claim 1, wherein the input device is configured to issue at least one control signal in response to at least one of (i) manual entry by the user of the command and (ii) receipt of a voice command from the user.

4. The apparatus of claim 1, wherein the input device is configured to issue at least one control signal without requiring receipt of a manual entry and without requiring receipt of a voice command from the user.

5. The apparatus of claim 1, wherein the input device is located on the vertical support member.

6. The apparatus of claim 1 , further comprising a connector which has a first end connected to the support platform and at least one handle which is associated with the connector and which is configured to be gripped and pulled by a user on the platform, the handle containing the input device.

7. An exercise device comprising:

a vertical support member;

at least one support rail having first and second end portions, the first end portion of the at least one support rail configured to be supported on a floor and the second end portion of the at least support rail slidably engaged with the vertical support member, wherein the at least one support rail is oriented at an inclination angle Θ relative to the floor;

a user support platform slidably engaged with the at least one support rail;

an input device located adjacent to or on the user support platform, the input device configured to receive a command from the user to initiate a change in the inclination angle Θ and to generate a control signal in response to such command; and an actuation mechanism associated with the vertical support member, the actuation mechanism configured to selectively adjust the position of the second end portion of the at least one support rail relative to the vertical support member in response to the control signal, thereby changing the inclination angle Θ, wherein the actuation mechanism includes a leadscrew assembly having a drive motor and a lead screw, the drive motor coupled to the lead screw for rotating the lead screw to cause translation of the second end portion of the at least one rail along the vertical support member by a selected amount in response to receipt of a control signal from the input device.

8. The exercise device of claim 7, wherein the input device is located on the vertical support member.

9. The exercise device of claim 7, further comprising at least one handle that contains the input device.

10. An exercise device comprising:

a vertical support member;

at least one support rail having first and second end portions, the first end portion of the at least one support rail configured to be supported on a floor and the second end portion of the at least support rail slidably engaged with the vertical support member, wherein the at least one support rail is oriented at an inclination angle Θ relative to the floor;

a user support platform slidably engaged with the at least one support rail;

an input device located adjacent to the user supported on the user support platform, the input device configured to receive a command from the user to initiate a change in the inclination angle Θ and to generate a control signal in response to such command; and an actuation mechanism associated with the vertical support member, the actuation mechanism configured to selectively adjust the position of the second end portion of the at least one support rail relative to the vertical support member in response to the control signal, thereby changing the inclination angle 0, wherein the actuation mechanism includes a leadscrew assembly having a drive motor and a lead screw, the drive motor coupled to the lead screw for rotating the lead screw to cause translation of the second end portion of the at least one rail along the vertical support member by a selected amount in response to receipt of a control signal from the input device.

11. The exercise device of claim 10, wherein the input device is located on the vertical support member.

12. The exercise device of claim 10, further comprising at least one handle that contains the input device.

* * * * *